US008201498B2

(12) United States Patent
Ebina

(10) Patent No.: US 8,201,498 B2
(45) Date of Patent: Jun. 19, 2012

(54) BLANKET/PLATE MOUNTING APPARATUS HAVING ONE DRIVE UNIT FOR AUTOMATICALLY TIGHTENING THE BLANKET/PLATE

(75) Inventor: Toshihiko Ebina, Ibaraki (JP)

(73) Assignee: Komori Corporation, Tokyo (JP)

( * ) Notice: Subject to any disclaimer, the term of this patent is extended or adjusted under 35 U.S.C. 154(b) by 723 days.

(21) Appl. No.: 12/316,423

(22) Filed: Dec. 12, 2008

(65) Prior Publication Data

US 2009/0151581 A1 Jun. 18, 2009

(30) Foreign Application Priority Data

Dec. 13, 2007 (JP) ..... 2007-321708

(51) Int. Cl.
*B41F 27/12* (2006.01)

(52) U.S. Cl. ..... 101/415.1; 101/378

(58) Field of Classification Search ..... 101/409, 101/410, 415.1, 378
See application file for complete search history.

(56) References Cited

U.S. PATENT DOCUMENTS

| | | | | |
|---|---|---|---|---|
| 2,850,970 | A * | 9/1958 | Brodie | 101/415.1 |
| 2,953,090 | A * | 9/1960 | Scott | 101/378 |
| 5,315,931 | A | 5/1994 | Doersam | |
| 5,337,666 | A * | 8/1994 | Becker | 101/415.1 |
| 6,520,085 | B1 * | 2/2003 | Heiler et al. | 101/415.1 |

FOREIGN PATENT DOCUMENTS

| | | |
|---|---|---|
| DE | 195 37 420 | 3/1997 |
| DE | 101 08 745 | 5/2002 |
| GB | 203883 | 9/1923 |
| JP | 01-215541 A | 8/1989 |

* cited by examiner

*Primary Examiner* — Leslie J Evanisko
(74) *Attorney, Agent, or Firm* — Blakely, Sokoloff, Taylor & Zafman

(57) ABSTRACT

A blanket/plate mounting apparatus includes a leading edge holding unit, trailing edge holding unit, and first drive unit. The leading edge holding unit is movably supported by a cylinder and holds the leading edge of a blanket/plate. The trailing edge holding unit is movably supported by the cylinder and holds the trailing edge of the blanket/plate. The first drive unit moves the leading edge holding unit and the trailing edge holding unit that respectively hold the leading edge and trailing edge of the blanket/plate mounted on the circumferential surface of the cylinder, thus tightening the blanket/plate.

15 Claims, 9 Drawing Sheets

BLANKET/PLATE MOUNTING APPARATUS HAVING ONE DRIVE UNIT FOR AUTOMATICALLY TIGHTENING THE BLANKET/PLATE

BACKGROUND OF THE INVENTION

The present invention relates to a blanket/plate mounting apparatus used to mount a blanket/resin plate on the circumferential surface of the coater cylinder of a coating machine or to mount a blanket on the circumferential surface of the blanket cylinder of an offset printing press.

A blanket of this type is made of an extendable material obtained by stacking rubber layers and fabrics alternately. Hence, after winding the blanket on the circumferential surface of the coater cylinder of a coating apparatus, the leading edge or trailing edge of the blanket is pulled to bring the blanket into tight contact with the circumferential surface of the cylinder, thus tightening the blanket.

As shown in Japanese Patent Laid-Open No. 1-215541, a conventional blanket/plate mounting apparatus comprises a leading edge winding bar and trailing edge winding bar pivotally, axially extending in the notch of a blanket cylinder, a worm wheel axially mounted on each end shaft of each of the two winding bars, a worm to mesh with the worm wheel, and a worm shaft on which the worm is axially mounted and which has a hexagonal head. When fitting a box spanner with the hexagonal head of the worm shaft and pivoting the box spanner, the blanket gripped by the two winding bars and wound around the circumferential surface of the blanket cylinder is mounted on the circumferential surface of the blanket cylinder in a tight state.

In the conventional blanket/plate mounting apparatus, the blanket is manually tightened. This increases the work load on the operator.

SUMMARY OF THE INVENTION

It is an object of the present invention to provide a blanket/plate mounting apparatus in which the load on the operator in tightening a blanket/plate is reduced.

In order to achieve the above object, according to the present invention, there is provided a blanket/plate mounting apparatus comprising a leading edge holding unit which is movably supported by a cylinder and holds a leading edge of a blanket/plate, a trailing edge holding unit which is movably supported by the cylinder and holds a trailing edge of the blanket/plate, and a first drive unit which moves the leading edge holding unit and the trailing edge holding unit that respectively hold the leading edge and the trailing edge of the blanket/plate mounted on a circumferential surface of the cylinder, thus tightening the blanket/plate.

DESCRIPTION OF THE PREFERRED EMBODIMENT

A blanket/plate mounting apparatus according to an embodiment of the present invention will be described in detail with reference to FIGS. 1 to 10.

Figure 1:
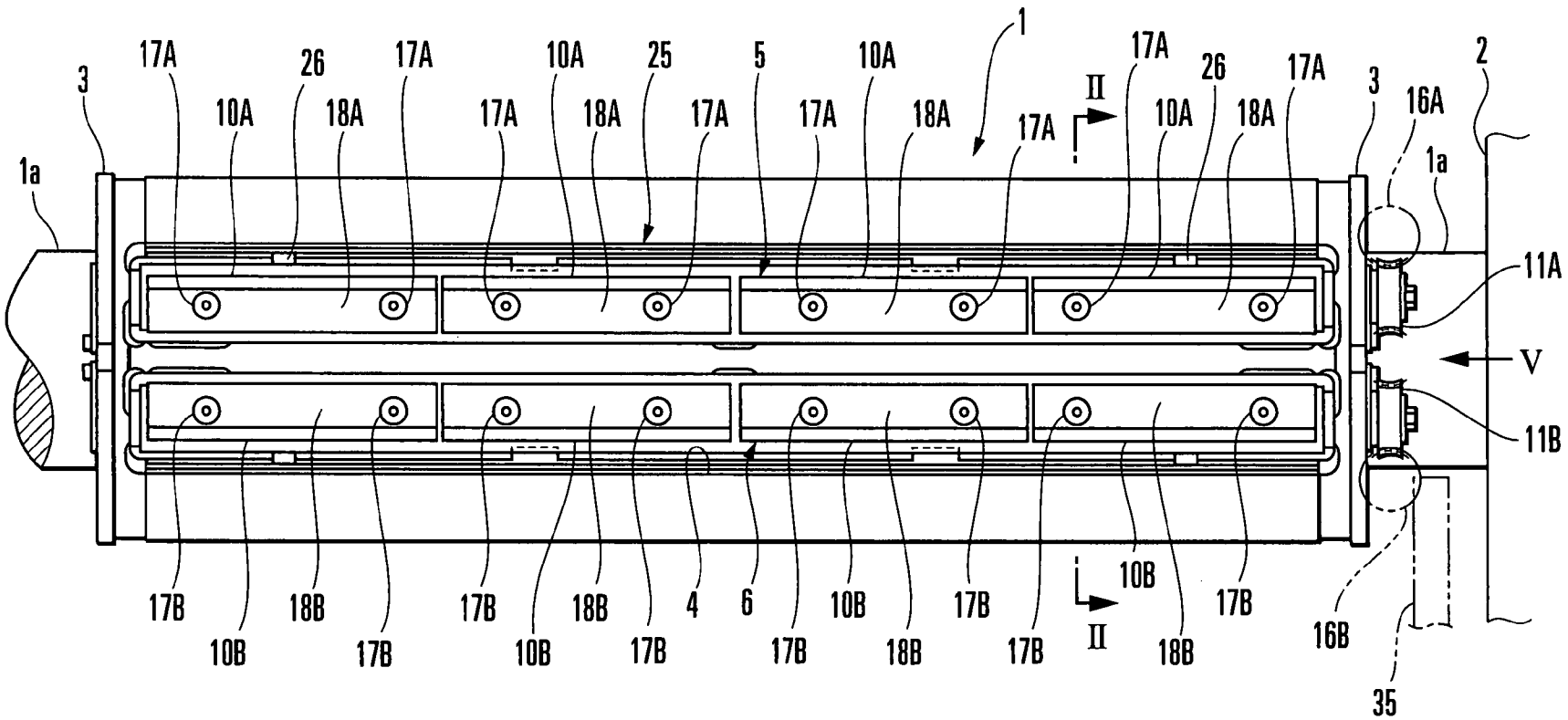
FIG. 1 is a plan view of a coater cylinder to which a blanket/plate mounting apparatus according to the present invention is applied.

As shown in FIG. 1, a coater cylinder 1 comprises a pair of bearers 3 at its two ends. Two end shafts 1*a* are rotatably supported by a pair of frames 2 (one frame is not illustrated). Between the pair of bearers 3, a notch 4 is formed in the coater cylinder 1 along its entire length. A leading edge plate clamp 5 (leading edge holding unit) and a trailing edge plate clamp 6 (trailing edge holding unit) serving as a trailing edge holding unit indicated by reference numeral 6 extend in the notch 4 parallel to each other in the direction of the cylinder axis.

Figure 2:
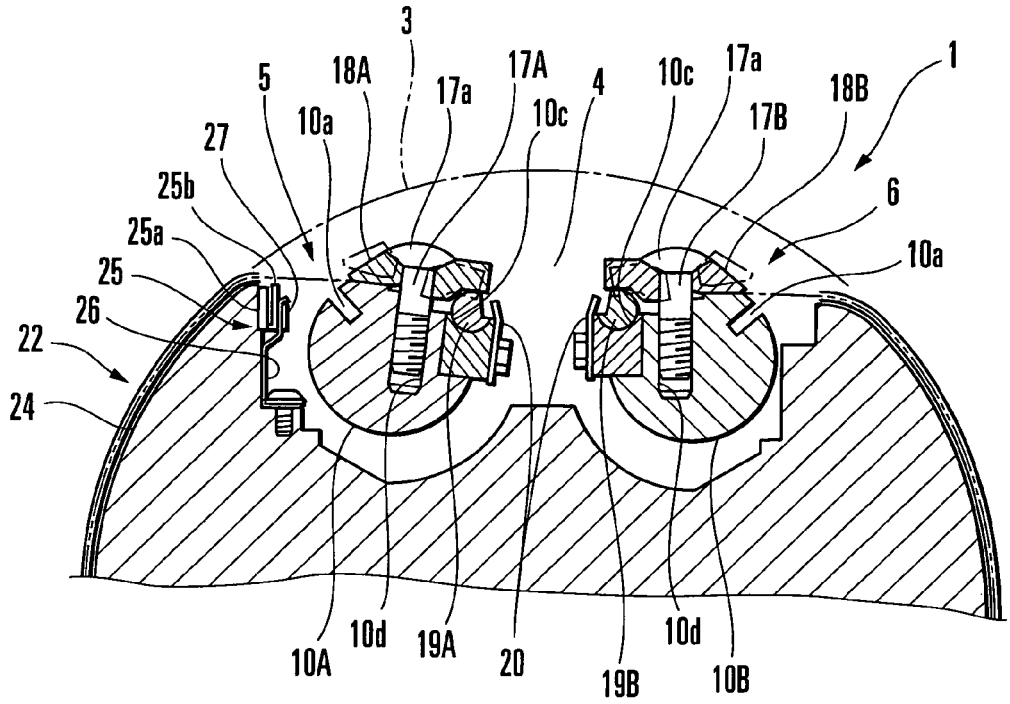
FIG. 2 is a sectional view taken along the line II-II of FIG. 1 and shows a state in which a resin plate is mounted.
Figure 5:
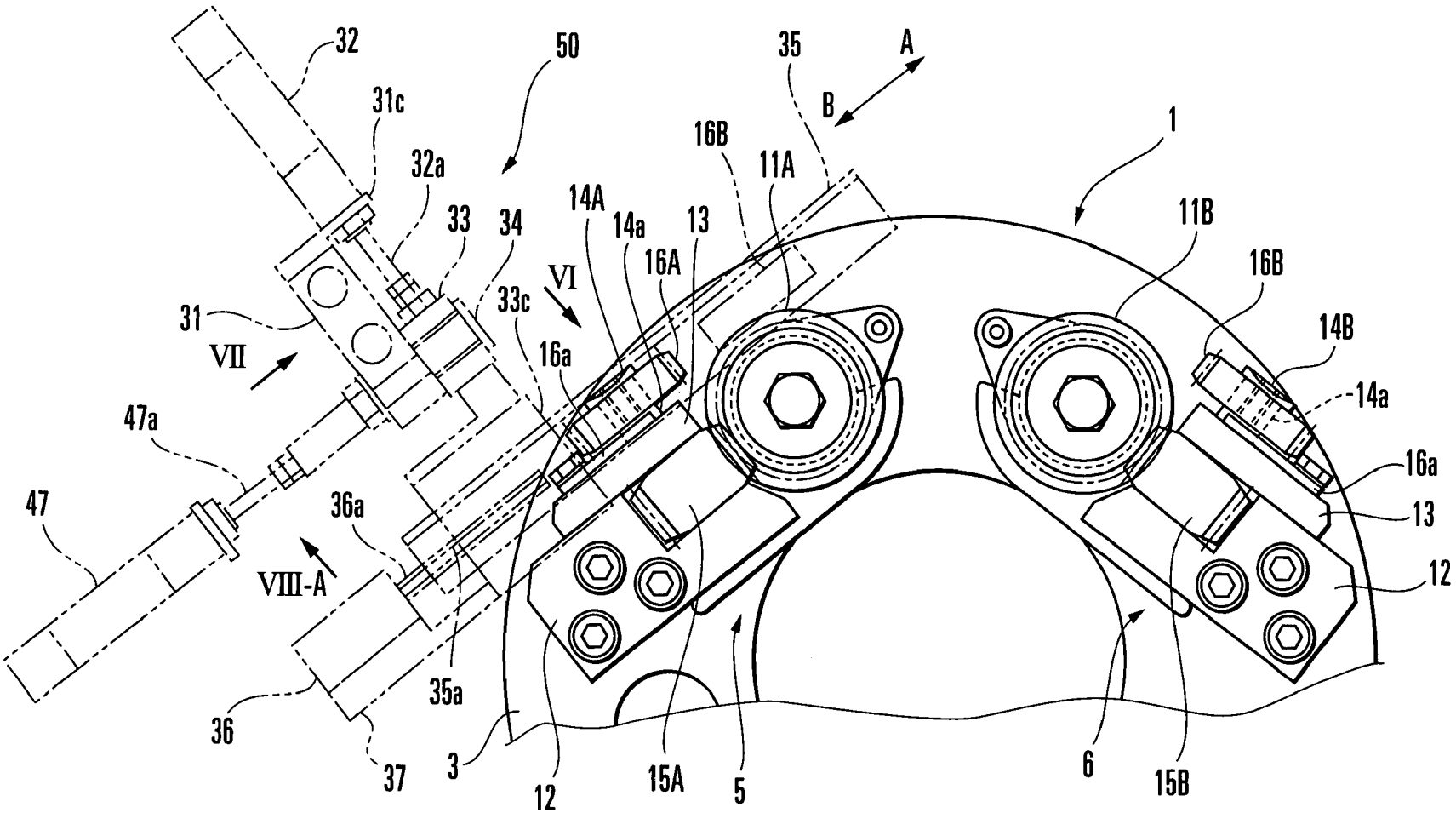
FIG. 5 is a view seen from the direction of an arrow V in FIG. 1.
Figure 6:
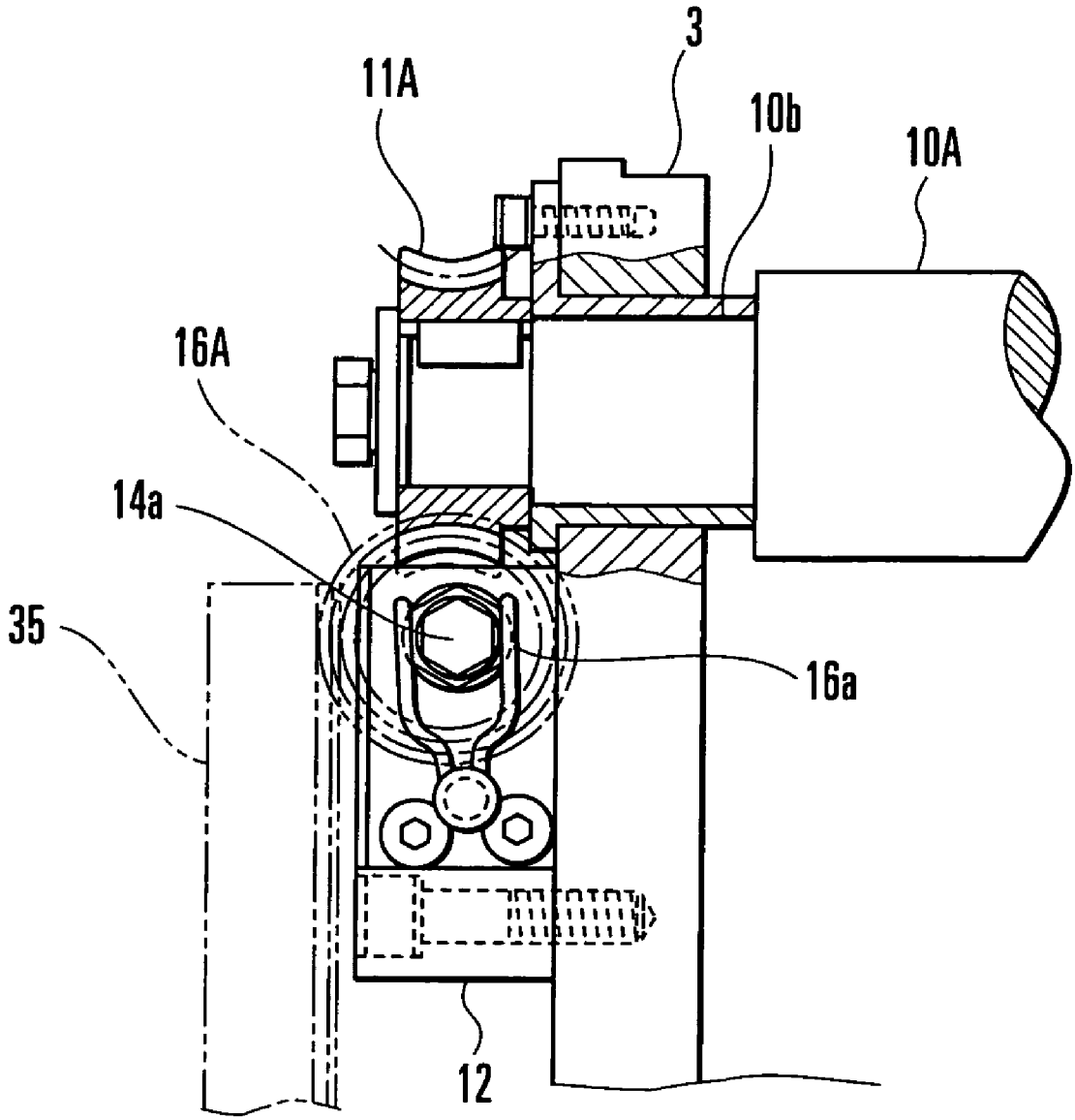
FIG. 6 is a view seen from the direction of an arrow VI in FIG. 5.

As shown in FIG. 2, each of the leading edge plate clamp 5 and trailing edge plate clamp 6 has elongated winding rods 10A and 10B extending in the direction of the cylinder axis. Each of the winding rods 10A and 10B has a circular section and a mouthpiece insertion groove 10*a* throughout the entire length. As shown in FIG. 6, end shafts 10*b* of the endmost winding rods 10A and end shafts 10*b* of the endmost winding rods 10B (the end shafts of the two endmost winding rods 10B are not illustrated) are pivotally, axially supported in the shaft holes of the pair of bearers 3. A worm wheel 11A is axially mounted on one end shaft 10*b* of the endmost winding rod 10A which projects from the bearer 3, and a worm wheel 11B is axially mounted on one end shaft 10*b* of the endmost winding rod 10B which projects from the bearer 3. As shown in FIG. 5, the worm wheels 11A and 11B mesh with worms 15A and 15B axially mounted on worm shafts 14A and 14B, respectively. The worm shafts 14A and 14B are rotatably supported by stationary plates 12 fixed to the end face of the corresponding bearer 3 and brackets 13 fixed to the corresponding stationary plates 12.

U-shaped click members 16*a* formed of leaf springs are fixed to the brackets 13, respectively. The click member 16*a* engages with a hexagonal head 14*a* formed on one end of each of the worm shafts 14A and 14B. The click members 16*a* regulate floating of the worm shafts 14A and 14B so they do not pivot without applying an external force. Pinions 16A and 16B are axially mounted on the hexagonal heads 14*a* of the worm shafts 14A and 14B, respectively.

As shown in FIG. 2, gripper board support bolts 17A and 17B having semispherical heads 17*a* are screwed in a plurality of screw holes 10*d* which are formed in the winding rods 10A and 10B to line up in the direction of cylindrical axes to form two rows. The gripper board support bolts 17A and 17B can be adjustable to advance/retreat. Elongated gripper boards 18A and 18B having the same length as that of the corresponding winding rods 10A and 10B have semispherical holes to correspond to the gripper board support bolts 17A and 17B. When the semispherical holes of the gripper boards 18A and 18B are fitted with the heads 17*a* of the gripper board support bolts 17A and 17B, the gripper board support bolts 17A and 17B swingably support the gripper boards 18A and 18B, respectively. Grooves 10*c* each having a semicircular section are formed in the upper portions of the opposing circumferential surfaces of the winding rods 10A and 10B, respectively. Round rod-like cam shafts 19A and 19B each having a notch throughout the entire length are pivotally, axially supported in the grooves 10*c* as they are regulated by the gripper boards 18A and 18B and leaf springs 20 of the winding rods 10A and 10B not to come off.

When the rear ends (halves closer to the center of the elongated notch 4) of the gripper boards 18A and 18B come into contact with the notches of the cam shafts 19A and 19B, biasing forces of biasing members (not shown) buried in the winding rods 10A and 10B open the gripper boards 18A and 18B, respectively. When the rear ends of the gripper boards 18A and 18B come into contact with the circumferential surfaces of the cam shafts 19A and 19B, the gripper boards 18A and 18B are closed respectively. When the gripper boards 18A and 18B close and the projecting ridges of their gripping surfaces engage with the grooves of the gripping surfaces of the winding rods 10A and 10B, the blanket 21 or 23, or the resin plate 22 is gripped.

Figure 3:
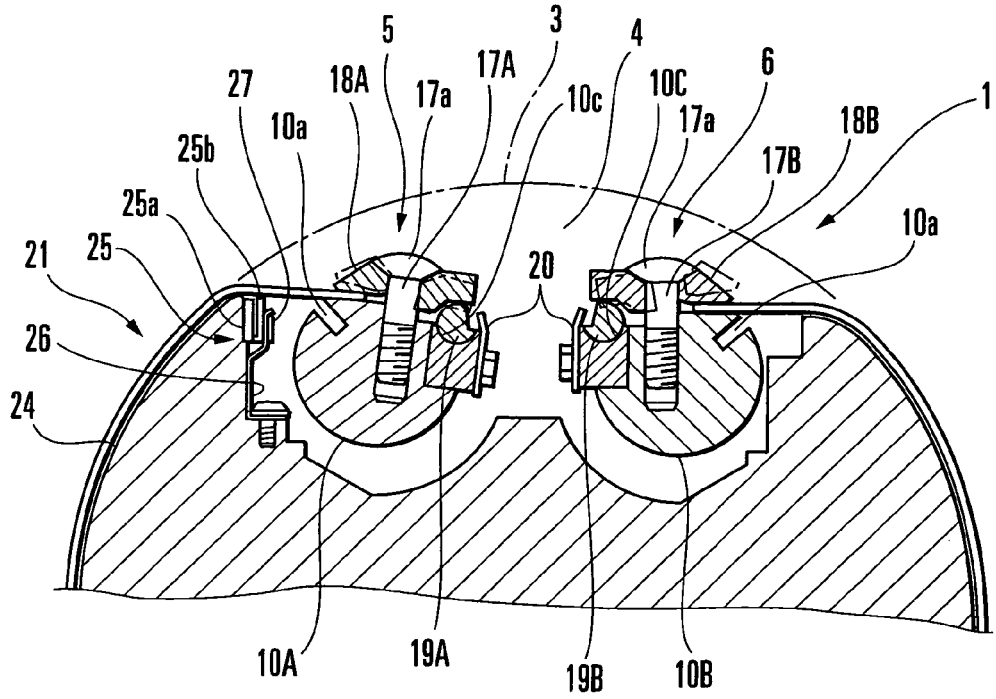
FIG. 3 is a sectional view taken along the line II-II of FIG. 1 and shows a state in which a blanket with no mouthpiece is mounted.
Figure 4:
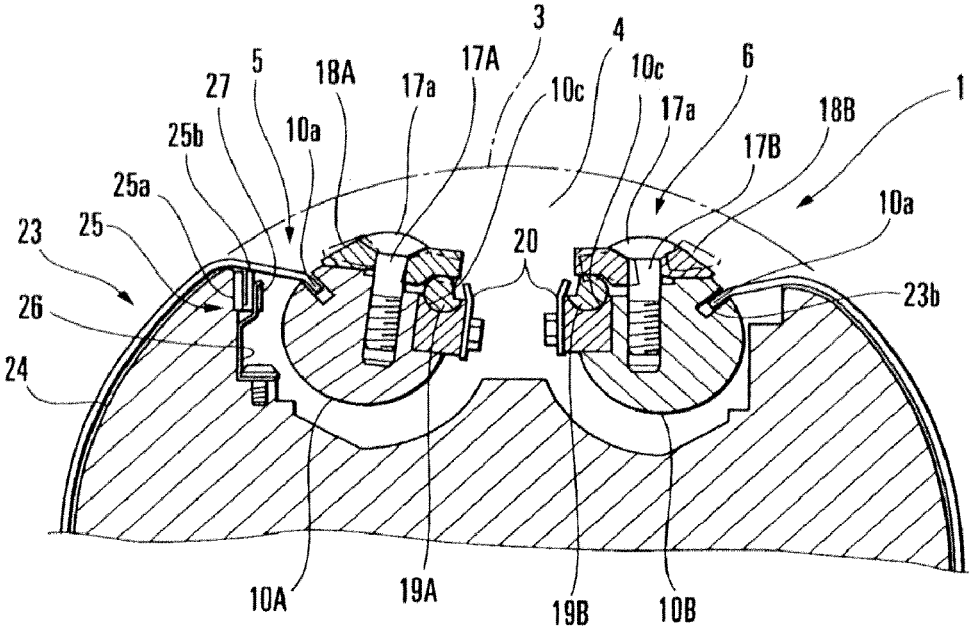
FIG. 4 is a sectional view taken along the line II-II of FIG. 1 and shows a state in which a blanket with a mouthpiece is mounted.

A lining 24 is shared by the blankets 21 and 23 and resin plate 22. As shown in FIGS. 2 to 4, a mouthpiece 25 comprising a pair of plates 25*a* and 25*b* which clamp the lining 24 and a plurality of bolts (not shown) which fix the plates 25*a* and 25*b* is mounted on one end of the lining 24. In this arrangement, when the pin hole of the mouthpiece 25 and a pin hole of a leaf spring 26 fixed to the bottom of the notch 4 are aligned with each other and a pin 27 is inserted in the aligned pin holes, the lining 24 is elastically held by the leaf spring 26 with respect to the wall surface of the notch 4.

Figure 10:
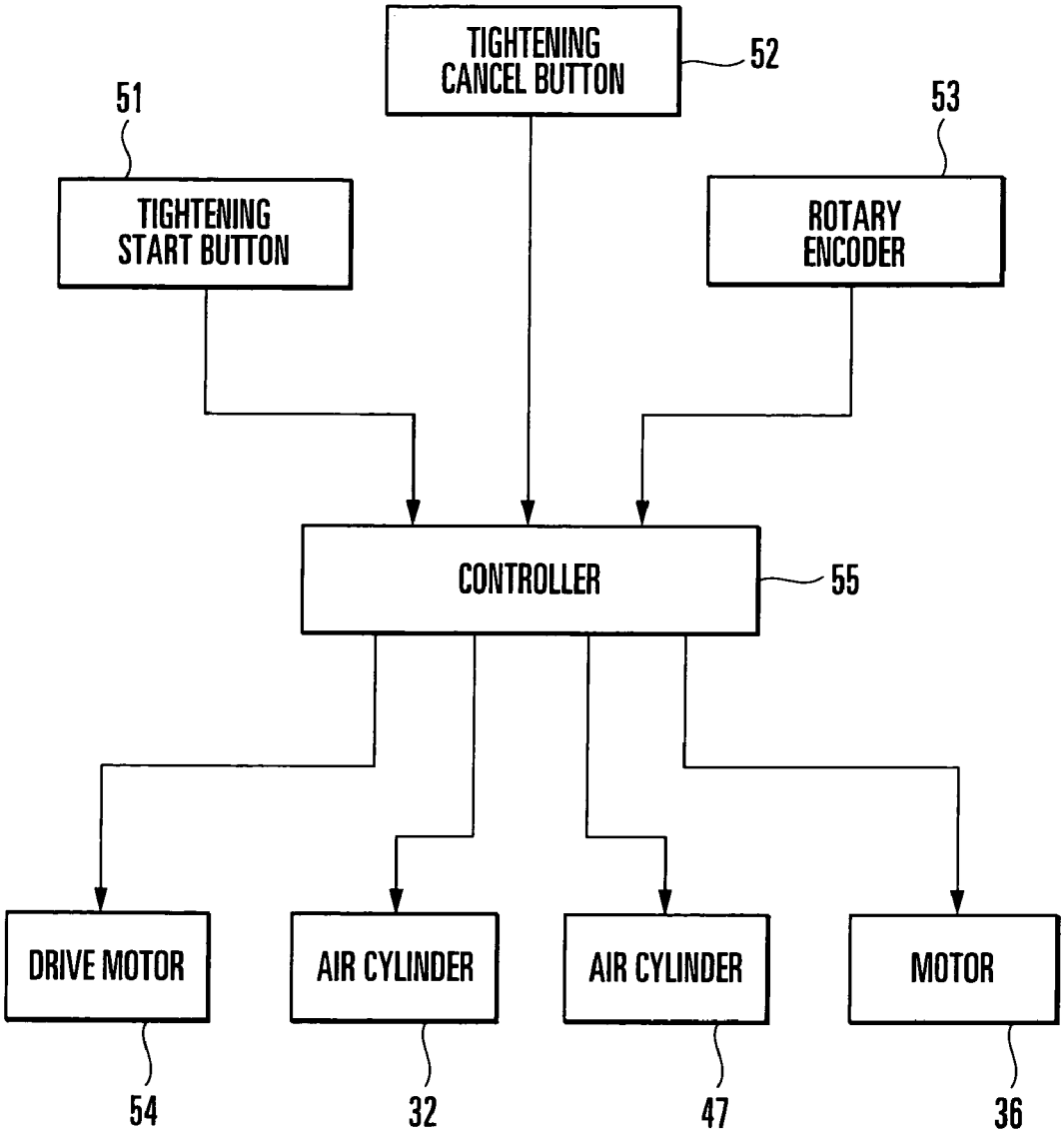
FIG. 10 is a block diagram showing the electrical configuration of the blanket/plate mounting apparatus according to the present invention.

The electrical configuration of the apparatus of this embodiment will be described with reference to FIG. 10. As shown in FIG. 10, a controller 55 is connected to air cylinders 32 and 47 (to be described later), a motor 36 (to be described later), a tightening start button 51, a tightening cancel button 52, a rotary encoder 53, and a drive motor 54. The tightening start button 51 instructs mounting start of the blanket/resin plate. The tightening cancel button 52 instructs mounting cancel of the blanket/resin plate. The rotary encoder 53 (rotary phase detection unit) detects the pivot phase of the coater cylinder 1 on the basis of the rotation pulses generated by the rotation of the coater cylinder 1. The drive motor 54 drives the coating machine including the coater cylinder 1. The controller 55 controls the operations of the motor 36, air cylinders 32 and 47, and drive motor 54 on the basis of outputs from the tightening start button 51 and rotary encoder 53. In particular, as will be described later, the controller 55 stops the coater cylinder 1 at a predetermined pivot position so that pinions 16A and 16B selectively mesh with a rack 35.

Figure 7:
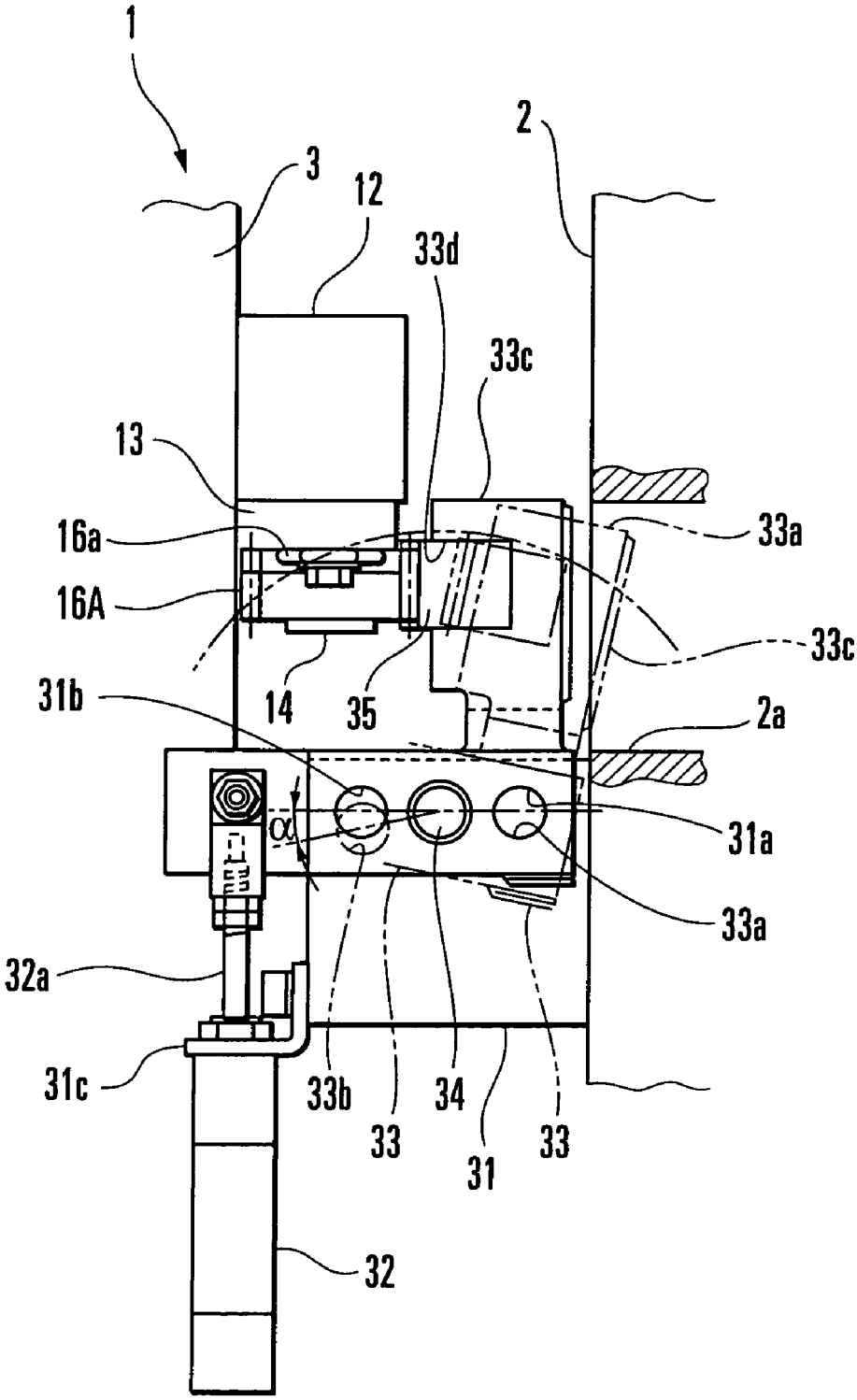
FIG. 7 is a view seen from the direction of an arrow VII in FIG. 5.

A structure that automatically tightens the blanket/resin plate wound around the circumferential surface of the coater cylinder 1 will be described with reference to FIG. 5 and FIGS. 7 to 9C. As shown in FIG. 7, a pair of pin insertion holes 31*a* and 31*b* are formed in the upper end of a stationary base 31 fixed inside the frame 2 at a phase gap of 180° in the circumferential direction about a small shaft 34 as the center. The first air cylinder 32 (second drive unit) serving as an actuator is fixed to that end face of the stationary base 31 on the coater cylinder 1 side through a bracket 31*c*. The advancing/retreating direction of a rod 32*a* of the air cylinder 32 is parallel to the end face of the coater cylinder 1 and directed in the direction of diameter of the coater cylinder 1.

A swing block 33 is swingably supported on the stationary base 31 through the small shaft 34 located at the center between the pin insertion holes 31*a* and 31*b*. The swing block 33 has a pair of pin insertion holes 33*a* and 33*b* through the small shaft 34. The rod 32*a* of the air cylinder 32 is pivotally mounted on the end of the swing block 33. The pair of pin insertion holes 33*a* and 33*b* are formed at such positions that one of them is shifted by an angle α from the phase gap of 180° in the circumferential direction about the small shaft 34 as the center. Thus, when the swing block 33 swings and the pin insertion holes 31*a* and 33*a* oppose each other, the pin insertion holes 31*b* and 33*b* do not oppose each other. When the pin insertion holes 31*b* and 33*b* oppose each other, the pin insertion holes 31*a* and 33*a* do not oppose each other.

A guide portion 33*c* integrally extends from that end of the swing block 33 which is on the frame 2 side in the radial direction of the coater cylinder 1. The guide portion 33*c* (support member) has a guide groove 33*d* that supports the rack 35 meshing with the pinions 16A and 16B to be movable in the direction of arrows A-B (the direction of tangent to the coater cylinder 1) in FIG. 5.

In this arrangement, when the rod 32*a* of the air cylinder 32 retreats, the swing block 33 pivots counterclockwise in FIG. 7 about the small shaft 34 as the pivot center. Thus, the rack 35 meshes with the pinion 16A, and the pin insertion hole 33*a* almost overlaps (coincides with) the pin insertion hole 31*a* of the stationary base 31. When the rod 32*a* of the air cylinder 32 advances, the swing block 33 pivots clockwise in FIG. 7 about the small shaft 34 as the pivot center. Thus, as indicated by an alternate long and two short dashed line, the rack 35 disengages from the pinion 16A, and the pin insertion hole 33*b* almost overlaps the pin insertion hole 31*b* of the stationary base 31. The frame 2 has an elongated groove 2*a*. The elongated groove 2*a* is formed to prevent the frame 2 from interfering with the guide portion 33*c* when the swing block 33 swings.

As shown in FIG. 5, the motor 36 (first drive unit) serving as an actuator is fixed to a base 37 attached to the guide portion 33*c* of the swing block 33. A screw shaft 36*a* which rotates together with the output shaft of the motor 36 meshes with a threaded hole 35*a* of the rack 35. When the rack 35 meshes with the leading edge pinion 16A, the motor 36 drives in one direction to move the rack 35 in the direction of an arrow A. Thus, the pinion 16A meshing with the rack 35 rotates, and the worm wheel 11A rotates clockwise in FIG. 5 through the worm shaft 14A and worm 15A. When the rack 35 meshes with the trailing edge pinion 16B, the motor 36 drives in the other direction (direction opposite to one direction), and the rack 35 moves in the direction of an arrow B. This rotates the pinion 16B meshing with the rack 35, so that the worm wheel 11B rotates counterclockwise in FIG. 5 through the worm shaft 14B and worm 15B.

Figure 8A:
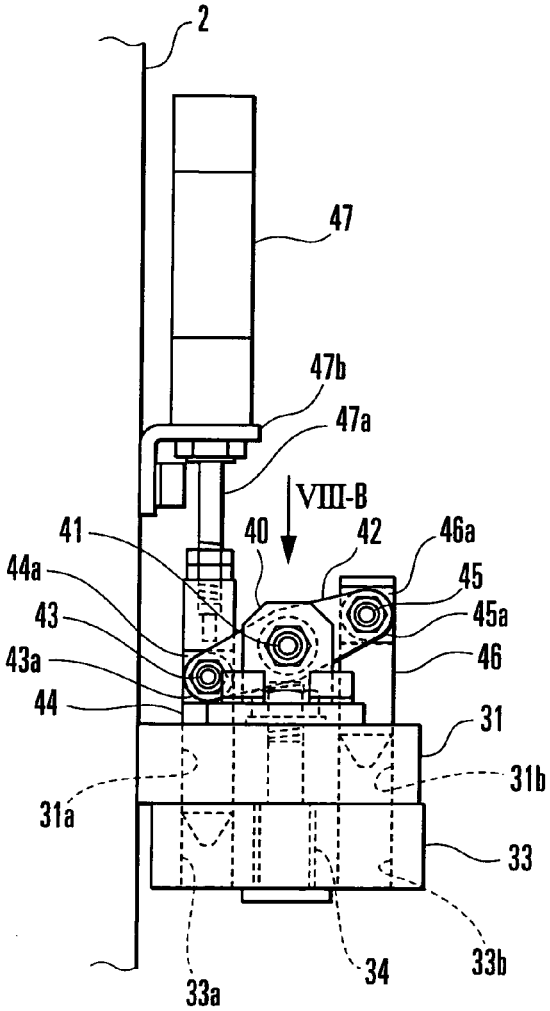
FIG. 8A is a view seen from the direction of an arrow VII-A in FIG. 5.
Figure 8B:
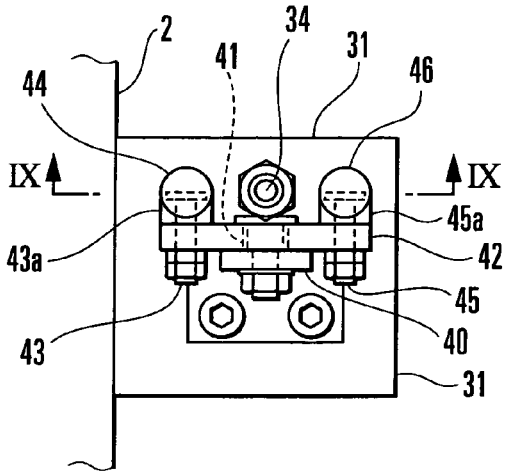
FIG. 8B is a view seen from the direction of an arrow VIII-B in FIG. 8A.
Figure 9C:
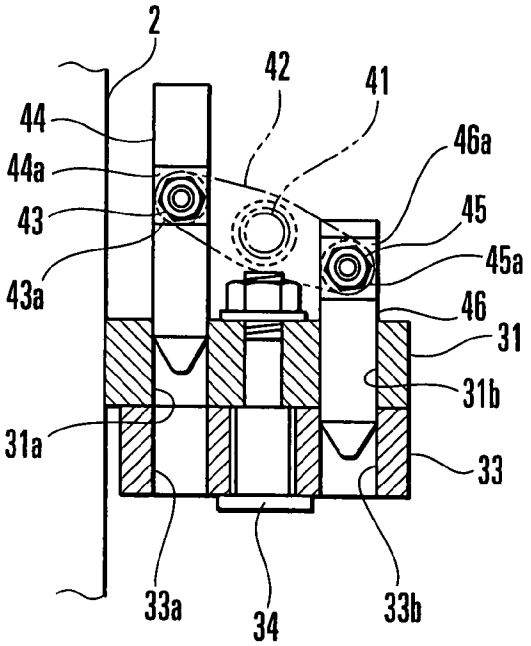
FIGS. 9A, 9B, and 9C are views seen from the direction of an arrow IX in FIG. 8B and respectively show a state in which a rack and pinion are held in a meshing state, a state in which a swing block which supports the rack is swingable, and a state in which the rack and pinion are held in a disengaged state.

As shown in FIG. 8A, a support plate 40 is fixed to that surface of the stationary base 31 which is opposite to a surface that supports the swing block 33. A lever 42 is supported at the center of the support plate 40 through a small shaft 41 to be swingable in the direction of thickness of the stationary base 31. A wheel 43*a* is pivotally mounted on one end of the lever 42 through a bolt 43. The wheel 43*a* meshes with a notch 44*a* of a pin 44 inserted in the pin insertion hole 31*a* of the stationary base 31. A wheel 45*a* is pivotally mounted on the other end of the lever 42 through a bolt 45. The wheel 45*a* is fitted in a notch 46*a* of a pin 46 inserted in the pin insertion hole 31*b* of the stationary base 31. In this arrangement, the pins 44 and 46 move in opposite directions in response to the swing motion of the lever 42, and are selectively inserted in the pin insertion holes 31*a* and 31*b*, as shown in FIGS. 9A and 9C.

The second air cylinder 47 (third drive unit) serving as an actuator is fixed to the frame 2 through a bracket 47*b*. A rod 47*a* of the air cylinder 47 is positioned at three positions. As shown in FIG. 5, the rod 47*a* of the air cylinder 47 is connected to the pin 44 so it is directed in the direction of tangent to the coater cylinder 1.

As described above, when the rod 32*a* of the air cylinder 32 retreats, the rack 35 meshes with the pinion 16A, and the pin insertion hole 33*a* almost overlaps the first pin insertion hole 31*a* of the stationary base 31. At this time, when the rod 47*a* of the air cylinder 47 advances, the pin 44 is inserted in the pin insertion holes 33*a* and 31*a*, as shown in FIG. 9A. As the pin 44 holds the pin insertion holes 31*a* and 33*a* in the overlapping state, the rack 35 is held in the state to mesh with the pinion 16A.

At this time, assume that the pin insertion hole 33*a* is shifted from the pin insertion hole 31*a* more or less. As the distal end of the pin 44 is tapered, when the pin 44 is inserted, the pin insertion hole 33*a* moves in a direction to overlap the pin insertion hole 31*a* due to the taper of the pin 44. As a result, the rack 35 meshes with the pinion 16A reliably.

Also, as described above, when the rod 32*a* of the air cylinder 32 advances, the rack 35 disengages from the pinion 16A, and the pin insertion hole 33*b* almost overlaps the pin insertion hole 31*b* of the stationary base 31. At this time, the rod 47*a* of the air cylinder 47 retreats, and the pin 46 is inserted in the pin insertion holes 33*b* and 31*b*, as shown in FIG. 9C. As the pin 46 holds the pin insertion holes 31*b* and 33*b* in the overlapping state, the rack 35 is held in the state to be disengaged from the pinion 16A.

At this time, assume that the pin insertion hole 33*b* is shifted from the pin insertion hole 31*b* more or less. As the distal end of the pin 46 is tapered, when the pin 46 is inserted, the pin insertion hole 33*b* moves in a direction to overlap the pin insertion hole 31*b* due to the taper of the pin 46. As a result, the rack 35 disengages from the pinion 16A reliably.

Figure 9B:
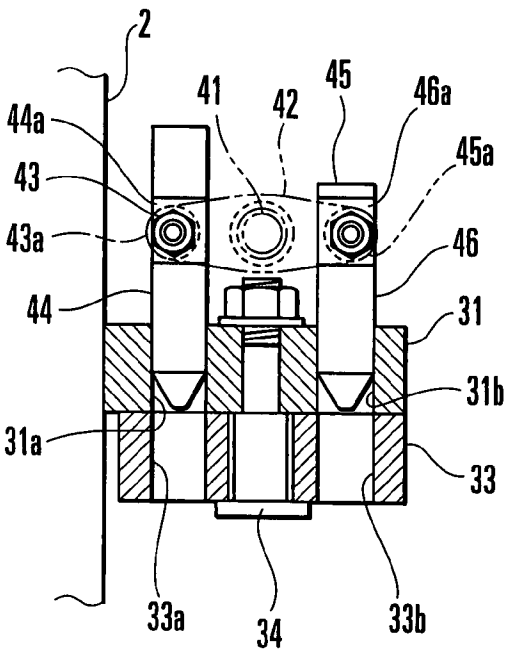
Figure 9A:
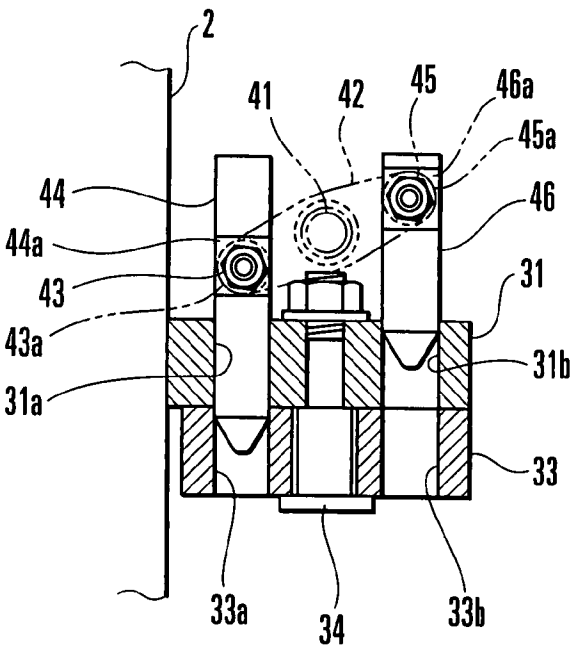

When the rod 47*a* of the air cylinder 47 is located at the intermediate position, the pins 44 and 46 retreat from the pin insertion holes 33*a* and 33*b* of the swing block 33, as shown in FIG. 9B. This enables the air cylinder 32 to swing the swing block 33. The air cylinders 32 and 47, swing block 33, rack 35, pinions 16A and 16B, and pins 44 and 46 constitute a tension unit 50 which tightens the blanket/plate wound around the circumferential surface of the coater cylinder 1 and brings it into tight contact with the circumferential surface of the coater cylinder 1.

The air cylinder 47, the pins 44 and 46 driven by the air cylinder 47 to move in opposite directions, the stationary base 31 having the pin insertion holes 31*a* and 31*b* respectively engageable with the pins 44 and 46, and the swing block 33 having the pin insertion holes 33*a* and 33*b* respectively engageable with the pins 44 and 46 constitute a meshing position locking unit, disengaging position locking unit, and meshing/disengaging position locking unit. In the meshing/disengaging position locking unit, the pins 44 and 46 and the pin insertion holes 31*a*, 31*b*, 33*a*, and 33*b* cooperate to selectively lock the rack 35 at a meshing position to mesh with the pinions 16A and 16B and a disengaging position to disengage from them. The meshing position locking unit and disengaging position locking unit similarly lock the rack 35 at the meshing position and the disengaging position, respectively.

Regarding the blanket/plate mounting apparatus having the above arrangement, the operation of mounting the blanket/plate will be described mainly by referring to the control operation of the controller 55. First, the operation of mounting the resin plate on the circumferential surface of the coater cylinder 1 will be described with reference to FIGS. 2 and 5, and FIGS. 7 to 9C.

First, the air cylinder 47 is operated to render it in the state shown in FIG. 9B (a state in which the swing block 33 is pivotal). Subsequently, the rod 32*a* of the air cylinder 32 is advanced to pivot the swing block 33, thus disengaging the rack 35 from the pinion 16A. Then, the air cylinder 47 is operated to render it in the state shown in FIG. 9C (a state in which the rack 35 is positioned at the meshing/disengaging position).

As shown in FIG. 2, the mouthpiece 25 of the lining 24 is fixed to the wall surface of the notch 4. The cam shaft 19A of the leading edge plate clamp 5 is pivoted to engage the notch of the cam shaft 19A with the rear end of the gripper board 18A, thus opening the gripper board 18A. The leading edge of the resin plate 22 is inserted between the gripper board 18A and the two gripper surfaces of each winding rod 10A. The cam shaft 19A is pivoted to engage the circular portion with the rear end of the gripper board 18A, thus closing the gripper board 18A. Hence, the leading edge plate clamp 5 grips the leading edge of the resin plate 22.

Subsequently, the coater cylinder 1 is rotated almost by one turn while overlaying the resin plate 22 and lining 24, so that the resin plate 22 and lining 24 are wound around the circumferential surface of the coater cylinder 1. The cam shaft 19B of the trailing edge plate clamp 6 is pivoted to engage the notch with the rear end of the gripper board 18B, thus opening the gripper board 18B. The trailing edge of the resin plate 22 is inserted between the gripper board 18B and the two gripper surfaces of the winding rods 10B. The cam shaft 19B is pivoted to engage the circular portion with the rear end of the gripper board 18B, thus closing the gripper board 18B. Hence, the trailing edge plate clamp 6 grips the trailing edge of the resin plate 22.

In this state, when the tightening start button 51 is turned on, the drive motor 54 (fourth drive unit) operates to pivot the coater cylinder 1 clockwise in FIG. 5. When the rotary encoder 53 detects that the pinion 16A of the leading edge plate clamp 5 corresponds to the rack 35, the drive motor 54 stops operation. Then, the air cylinder 47 is operated to render it in the state shown in FIG. 9B. The rod 32*a* of the air cylinder 32 then retreats to mesh the rack 35 with the pinion 16A. In this state, the rod 47*a* of the air cylinder 47 advances to insert the pin 44 in the pin insertion holes 33*a* and 31*a*, as shown in FIG. 9A. Thus, the pin 44 holds the pin insertion holes 31*a* and 33*a* in the overlapping state, so that the rack 35 is held in the state to mesh with the pinion 16A.

Then, the motor 36 is driven in one direction to move the rack 35 in the direction of the arrow A in FIG. 5. Thus, the pinion 16A meshing with the rack 35 rotates, and the worm wheel 11A rotates clockwise in FIG. 5 through the worm shaft 14A and worm 15A. When the worm wheel 11A rotates, the winding rods 10A of the leading edge plate clamp 5 pivot clockwise in FIG. 2. Thus, the resin plate 22, the leading edge of which is pulled by the leading edge plate clamp 5 and the trailing edge of which is gripped by the trailing edge plate clamp 6, is tightened and comes into tight contact with the circumferential surface of the coater cylinder 1.

After the motor 36 is driven in one direction for a predetermined amount and the trailing edge of the resin plate 22 is pulled, the rod 47*a* of the air cylinder 47 is positioned at the intermediate position. Thus, as shown in FIG. 9B, the pins 44 and 46 respectively retreat from the pin insertion holes 33*a* and 33*b* of the swing block 33. Subsequently, the rod 32*a* of the air cylinder 32 advances to disengage the pinion 16A from the rack 35, as indicated by an alternate long and two short dashed line in FIG. 7. Simultaneously, the rod 47*a* of the air cylinder 47 retreats to insert the pin 46 in the pin insertion hole 33*b* of the swing block 33, as shown in FIG. 9C. This holds the pinion 16A and rack 35 in the disengaged state.

Subsequently, the drive motor 54 is driven to slightly pivot the coater cylinder 1 counterclockwise in FIG. 5. At this time, when the rotary encoder 53 detects that the pinion 16B of the trailing edge plate clamp 6 corresponds to the rack 35, the drive motor 54 stops operation. Then, the rod 47*a* of the air cylinder 47 is positioned at the intermediate position, and the pins 44 and 46 respectively retreat from the pin insertion holes 33*a* and 33*b* of the swing block 33, as shown in FIG. 9B.

Then, the rod 32*a* of the air cylinder 32 retreats to mesh the rack 35 with the pinion 16B. Simultaneously, the rod 47*a* of the air cylinder 47 advances to insert the pin 44 in the pin insertion holes 33*a* and 31*a*, as shown in FIG. 9A. This holds the rack 35 and pinion 16A in the meshing state.

In this state, when the motor 36 is driven in the other direction, the rack 35 moves in the direction of the arrow B. Hence, the pinion 16B meshing with the rack 35 rotates, and the worm wheel 11B rotates counterclockwise in FIG. 5 through the worm shaft 14B and worm 15B. When the worm wheel 11B rotates, the winding rods 10B of the trailing edge plate clamp 6 pivot counterclockwise in FIG. 2. This pulls the trailing edge of the resin plate 22, so that the resin plate 22 tightens and comes into tight contact with the circumferential surface of the coater cylinder 1.

In this manner, the blanket/plate mounting apparatus comprises one motor 36 which selectively pivots the winding rods 10A of the leading edge plate clamp 5 and the winding rods 10B of the trailing edge plate clamp 6. Since the winding rods 10A and 10B need not be pivoted manually, the load on the operator can be reduced. Since the controller 55 controls to pull the leading and trailing edges of the resin plate 22 automatically, the operation time can be shortened, and any erroneous operation can be prevented.

The operation of loosening the resin plate 22 which is in tight contact with the circumferential surface of the coater cylinder 1 will be described. First, when the tightening cancel button 52 is turned on, the drive motor 54 is driven to pivot the coater cylinder 1 counterclockwise in FIG. 5. When the rotary encoder 53 detects that the pinion 16B of the trailing edge plate clamp 6 corresponds to the rack 35, the drive motor 54 stops operation. Then, the rod 47*a* of the air cylinder 47 is positioned at the intermediate position. This positions both the first and second pins 44 and 46 where they have retreated from the pin insertion holes 33*a* and 33*b* of the swing block 33, as shown in FIG. 9B.

Then, the rod 32*a* of the air cylinder 32 retreats to mesh the rack 35 with the pinion 16B. Simultaneously, the rod 47*a* of the air cylinder 47 advances to insert the pin 44 in the pin insertion holes 33*a* and 31*a*, as shown in FIG. 9A. This holds the rack 35 and pinion 16B in the meshing state.

In this state, when the motor 36 is driven in one direction, the rack 35 moves in the direction of the arrow A. Hence, the pinion 16B meshing with the rack 35 rotates, and the worm wheel 11B rotates clockwise in FIG. 5 through the worm shaft 14B and worm 15B. This rotation pivots the winding rods 10B of the trailing edge plate clamp 6 clockwise in FIG. 2. Thus, the trailing edge plate clamp 6 releases the trailing edge of the resin plate 22.

After the trailing edge plate clamp 6 releases the trailing edge of the resin plate 22, the rod 47*a* of the air cylinder 47 is positioned at the intermediate position. Hence, both the pins 44 and 46 are positioned where they have retreated from the pin insertion holes 33*a* and 33*b* of the swing block 33, as shown in FIG. 9B. Then, the rod 32*a* of the air cylinder 32 advances to disengage the pinion 16B from the rack 35. Simultaneously, the rod 47*a* of the air cylinder 47 retreats to insert the pin 46 in the second pin insertion hole 33*b* of the swing block 33, as shown in FIG. 9C. This holds the pinion 16B and rack 35 in the disengaged state.

Subsequently, the drive motor 54 is driven to slightly pivot the coater cylinder 1 clockwise in FIG. 5. At this time, when the rotary encoder 53 detects that the pinion 16A corresponds to the rack 35, the drive motor 54 stops operation. Then, the rod 47*a* of the air cylinder 47 is positioned at the intermediate position shown in FIG. 9B, and after that the rod 32*a* of the air cylinder 32 retreats to mesh the rack 35 with the pinion 16A. In this state, the rod 47*a* of the air cylinder 47 advances to insert the pin 44 in the pin insertion holes 33*a* and 31*a*, as shown in FIG. 9A. Thus, the pin 44 holds the pin insertion holes 31*a* and 33*a* in the overlapping state, and accordingly the rack 35 is held in the state to mesh with the pinion 16A.

In this state, when the motor 36 is driven in the other direction (a direction opposite to one direction), the rack 35 moves in the direction of the arrow B in FIG. 5. Therefore, the pinion 16A meshing with the rack 35 rotates, and the worm wheel 11A rotates counterclockwise in FIG. 5 through the worm shaft 14A and worm 15A. When the worm wheel 11A rotates, the winding rods 10A of the leading edge plate clamp 5 pivot counterclockwise in FIG. 2. Thus, the leading edge clamp 5 releases the leading edge of the resin plate 22, so that the resin plate 22 in tight contact with the circumferential surface of the coater cylinder 1 is loosened. In this embodiment, the winding amount (loosening amount) of the trailing edge is larger than the winding amount (loosening amount) of the leading edge.

Subsequently, the rod 47*a* of the air cylinder 47 is positioned at the intermediate position, and both the pins 44 and 46 respectively retreat from the pin insertion holes 33*a* and 33*b* of the swing block 33, as shown in FIG. 9B. The rod 32*a* of the air cylinder 32 advances to disengage the pinion 16A from the rack 35, as indicated by the alternate long and two short dashed line in FIG. 7. Simultaneously, the rod 47*a* of the air cylinder 47 retreats to insert the pin 46 in the pin insertion hole 33*b* of the swing block 33, as shown in FIG. 9C. This holds the pinion 16A and rack 35 in the disengaged state.

Subsequently, the cam shaft 19A of the leading edge plate clamp 5 (FIG. 2) is pivoted to engage the notch with the rear end of the gripper board 18A. This opens the gripper board 18A and disengages the leading edge of the resin plate 22 from the leading edge plate clamp 5. Simultaneously, in FIG. 2, the mouthpiece 25 of the lining 24 is disengaged from the wall surface of the notch 4. Then, the coater cylinder 1 is rotated almost by one turn, and the cam shaft 19B of the trailing edge plate clamp 6 is pivoted to engage the notch with the rear end of the gripper board 18B. This opens the gripper board 18B and disengages the trailing edge of the resin plate 22 from the trailing edge plate clamp 6, thus disengaging the resin plate 22 from the coater cylinder 1.

In this manner, the blanket/plate mounting apparatus comprises one motor 36 which selectively pivots the winding rods 10A of the leading edge plate clamp 5 and the winding rods 10B of the trailing edge plate clamp 6. Since the winding rods 10A and 10B need not be pivoted manually, the load on the operator can be reduced. Also, the operation of loosening the leading edge and trailing edge of the resin plate 22 can be performed automatically by the control operation of the controller 55. Thus, the operation time can be shortened, and erroneous operation can be prevented.

Assume that a blanket 21 with no mouthpiece is to be mounted on the circumferential surface of the coater cylinder 1. As shown in FIG. 3, the gripper board support bolt 17A of the leading edge plate clamp 5 and the gripper board support bolt 17B of the trailing edge plate clamp 6 are slightly moved upward in accordance with the thickness of the blanket 21. The gripper boards 18A and 18B are levitated more than in the case of the resin plate 22. After that, the blanket 21 is wound around the circumferential surface of the coater cylinder 1 in the same manner as the resin plate 22 described above, and then mounted by tightening.

Assume that a blanket 23 with a mouthpiece is to be mounted on the circumferential surface of the coater cylinder 1. As shown in FIG. 4, a mouthpiece 23*a* is inserted in mouthpiece insertion grooves 10*a* of the winding rods 10A of the leading edge plate clamp 5, as shown in FIG. 4. After that, the blanket 23 is wound around the circumferential surface of the coater cylinder 1. Then, a mouthpiece 23*b* is inserted in mouthpiece insertion grooves 10*a* of the winding rods 10B of the trailing edge plate clamp 6. After that, the blanket 23 is mounted on the circumferential surface of the coater cylinder 1 by tightening in the same manner as the resin plate 22 described above.

In this manner, the air cylinder 47 can position and fix the rack 35 at positions to mesh with the pinions 16A and 16B and positions to disengage from the pinions 16A and 16B. In the case of service interruption, the rack 35 will not undesirably move from the position where it has been positioned and fixed.

Although this embodiment exemplifies a case that uses the motor 36 as the driving source for the rack 35, the driving source may be an air cylinder or solenoid.

According to the present invention described above, the blanket/plate mounting apparatus comprises a drive unit that moves a leading edge holding unit and trailing edge holding unit. As the leading edge holding unit and trailing edge holding unit need not be moved manually, the load on the operator can be reduced.

What is claimed is:

1. A blanket/plate mounting apparatus comprising:

a leading edge holding unit which is movably supported by a cylinder and holds a leading edge of a blanket/plate;

a trailing edge holding unit which is movably supported by said cylinder and holds a trailing edge of the blanket/plate; and a first drive unit which moves said leading edge holding unit and said trailing edge holding unit that respectively hold the leading edge and the trailing edge of the blanket/plate mounted on a circumferential surface of said cylinder, thus tightening the blanket/plate;

wherein said leading edge holding unit comprises a first pivotal member that is pivoted by said fast drive unit while holding the leading edge of the blanket/plate, said trailing edge holding unit comprises a second pivotal member that is pivoted by said first drive unit while holding the trailing edge of the blanket/plate, and said first drive unit comprises an actuator that pivotally drives said first pivotal member and said second pivotal member selectively.

2. An apparatus according to claim 1, wherein said first drive unit comprises a rack which selectively meshes with a first pinion which transmits pivot motion to said pivotal member of said leading edge holding unit and a second pinion which transmits pivot motion to said pivotal member of said trailing edge holding unit, and a motor which moves said rack.

3. An apparatus according to claim 1, further comprising:

a first pinion which transmits rotation to said pivotal member of said leading edge holding unit, a second pinion which transmits rotation to said pivotal member of said trailing edge holding unit, a rack which selectively meshes with one of said first pinion and said second pinion and moves upon being driven by said first drive unit, and a second drive unit which moves said rack between a meshing position and a disengaging position with respect to said first pinion and said second pinion.

4. An apparatus according to claim 3, wherein said rack is capable of meshing with said first pinion and said second pinion upon rotation of said cylinder.

5. An apparatus according to claim 3, further comprising a support member which supports said rack, and a meshing position locking unit which fixes said support member at the meshing position to mesh with said first pinion and said second pinion.

6. An apparatus according to claim 3, further comprising a support member which supports said rack, and a disengaging position locking unit which fixes said support member at the disengaging position with respect to said first pinion and said second pinion.

7. An apparatus according to claim 3, further comprising a support member which supports said rack, and a meshing/disengaging position locking unit which selectively fixes said support member at the meshing position and the disengaging position with respect to said first pinion and said second pinion.

8. An apparatus according to claim 7, wherein said meshing/disengaging position locking unit comprises a first pin and a second pin which respectively fix said support member at the meshing position and the disengaging position, and a third drive unit which moves said first pin and said second pin in opposite directions to selectively perform meshing operation and disengaging operation.

9. An apparatus according to claim 8, wherein said first pin and said second pin respectively have tapers at distal ends thereof.

10. An apparatus according to claim 8, wherein said meshing/disengaging position locking unit comprises a stationary base including a pair of pin insertion holes, and a movable member which is movably supported by said stationary base and includes a pair of pin insertion holes formed at positions selectively oppose said pair of pin insertion holes of said stationary base in one to one correspondence regarding said each pair of pin insertion holes of said stationary base and said movable member, when said first pin is inserted in one pin insertion hole of said stationary base and one pin insertion hole of said movable member, said support member is locked at the meshing position with respect to said first pinion and said second pinion, and when said second pin is inserted in the other pin insertion hole of said stationary base and the other pin insertion hole of said movable member, said support member is locked at the disengaging position with respect to said first pinion and said second pinion.

11. An apparatus according to claim 10, wherein said movable member is rotatably supported by said stationary base.

12. An apparatus according to claim 10, wherein said second drive unit is operable when said first pin and said second pin are not respectively inserted in said one pin insertion hole of said stationary base and said other pin insertion hole of said movable member.

13. An apparatus according to claim 10, further comprising a fourth drive unit which rotatably drives said cylinder, a rotary phase detection unit which detects a rotary phase of said cylinder, and a control unit which receives an output from said rotary phase detection unit and controls operation of said first drive unit, said second drive unit, said third drive unit, and said fourth drive unit, wherein said control unit stops operation of said fourth drive unit when it is detected that said first pinion is at a position to correspond to said rack on the basis of the output from said rotary phase detection unit, subsequently operates said third drive unit to extract said second pin from said other pin insertion hole of said movable member, subsequently operates said second drive unit to move said one pin insertion hole of said movable member to a position to oppose said one pin insertion hole of said stationary base, subsequently operates said third drive unit to insert said first pin in said one pin insertion hole of said movable member, subsequently operates said first drive unit to tighten the blanket/plate, subsequently operates said third drive unit to extract said first pin from said one pin insertion hole of said movable member, subsequently operates said second drive unit to move said other pin insertion hole of said movable member to a position to oppose said other pin insertion hole of said stationary base, subsequently operates said third drive unit to insert said second pin in said other pin insertion hole of said movable member, subsequently stops operation of said fourth drive unit when it is detected that said second pinion is at a position to correspond to said rack on the basis of the output from said rotary phase detection unit, subsequently operates said third drive unit to extract said second pin from said other pin insertion hole of said movable member, subsequently operates said second drive unit to move said one pin insertion hole of said movable member to a position to oppose said one pin insertion hole of said stationary base, subsequently operates said third drive unit to insert said first pin in said one pin insertion hole of said movable member, and subsequently operates said first drive unit to tighten the blanket/plate.

14. An apparatus according to claim 10, further comprising a fourth drive unit which rotatably drives said cylinder, a rotary phase detection unit which detects a rotary phase of said cylinder, and a control unit which receives an output from said rotary phase detection unit and controls operation of said first drive unit, said second drive unit, said third drive unit, and said fourth drive unit, wherein said control unit stops operation of said fourth drive unit when it is detected that said second pinion is at a position to correspond to said rack on the basis of the output from said rotary phase detection unit, subsequently operates said third drive unit to extract said second pin from said other pin insertion hole of said movable member, subsequently operates said second drive unit to move said one pin insertion hole of said movable member to a position to oppose said one pin insertion hole of said stationary base, subsequently operates said third drive unit to insert said first pin in said one pin insertion hole of said movable member, subsequently operates said first drive unit to loosen the blanket/plate, subsequently operates said third drive unit to extract said first pin from said one pin insertion hole of said movable member, subsequently operates said second drive unit to move said other pin insertion hole of said movable member to a position to oppose said other pin insertion hole of said stationary base, subsequently operates said third drive unit to insert said second pin in said other pin insertion hole of said movable member, subsequently stops operation of said fourth drive unit when it is detected that said first pinion is at a position correspond to said rack on the basis of the output from said rotary phase detection unit, subsequently operates said third drive tin aid second pin from said other pin insertion hole of said movable member, subsequently operates said second drive unit to move said one pin insertion hole of said movable member to a position to oppose said one pin insertion hole of said stationary base, subsequently operates said third drive unit to insert said first pin in said one pin insertion hole of said movable member, and subsequently operates said first drive unit to loosen the blanket/plate.

15. A blanket/plate mounting apparatus comprising:

a leading edge holding unit (5) which holds a leading edge of a blanket/plate, said leading edge holding unit comprising a first pivotal member (10A) that is pivoted to fasten the blanket/plate while holding the leading edge of the blanket/plate;

a trailing edge holding unit (6) which holds a trailing edge of the blanket/plate, aid trailing edge holding unit comprising a second pivotal member (10B) that is pivoted to fasten the blanket/plate while holding the trailing edge of the blanket/plate;

an actuator (36) which pivotally drives said first pivotal member and said second pivotal member selectively so as to tension the blanket/cylinder as mounted on a circumferential surface of a cylinder; and a control unit which electrically controls an operation of said actuator.

* * * * *

UNITED STATES PATENT AND TRADEMARK OFFICE

CERTIFICATE OF CORRECTION

PATENT NO. : 8,201,498 B2
APPLICATION NO. : 12/316423
DATED : June 19, 2012
INVENTOR(S) : Toshihiko Ebina It is certified that error appears in the above-identified patent and that said Letters Patent is hereby corrected as shown below:

In the Claims, Column 9, Claim 1, line 55, please delete "fast" and insert --first--.

Column 10, Claim 10, line 46, please delete "unit comprises" and insert --unit further comprises--.

Column 12, Claim 14, line 27, please delete "position correspond" and insert --position to correspond--.

Column 12, Claim 14, line 30, please delete "drive tin aid" and insert --drive unit to extract said--.

Signed and Sealed this
Second Day of April, 2013

Teresa Stanek Rea
*Acting Director of the United States Patent and Trademark Office*